US007340796B2

(12) United States Patent
Pyles

(10) Patent No.: US 7,340,796 B2
(45) Date of Patent: Mar. 11, 2008

(54) PAINTING APPARATUS

(76) Inventor: Christopher Matthew Pyles, 9340 Hillery Dr. #4202, San Diego, CA (US) 92126

( * ) Notice: Subject to any disclaimer, the term of this patent is extended or adjusted under 35 U.S.C. 154(b) by 535 days.

(21) Appl. No.: 10/722,339

(22) Filed: Nov. 24, 2003

(65) Prior Publication Data

US 2004/0211016 A1 Oct. 28, 2004

Related U.S. Application Data

(63) Continuation-in-part of application No. 10/419,623, filed on Apr. 23, 2003, now abandoned.

(51) Int. Cl.
*B05C 17/02* (2006.01)

(52) U.S. Cl. ..... 15/114; 15/118; 15/166; 15/230.11; 15/248.2; 492/19

(58) Field of Classification Search ..... 15/114, 15/118, 166, 230.11, 248.2; 492/13, 19
See application file for complete search history.

(56) References Cited

U.S. PATENT DOCUMENTS 2,907,061 A 10/1959 Whalen
3,130,435 A 4/1964 Smith
3,205,526 A 9/1965 Archibald
3,369,269 A 2/1968 Deck et al.
3,623,180 A 11/1971 Anderson
3,942,209 A 3/1976 Walls
4,100,642 A 7/1978 Gabor
4,829,623 A 5/1989 Brezette et al.
5,386,610 A 2/1995 Batanjski
5,443,533 A 8/1995 Magnien
5,444,891 A 8/1995 Benson
5,623,740 A 4/1997 Burns et al.
6,000,090 A 12/1999 Sutherland

FOREIGN PATENT DOCUMENTS

DE 3306939 * 9/1987
DE 4419672 * 8/1995

* cited by examiner

*Primary Examiner*—Mark Spisich

(57) ABSTRACT

A painting apparatus facilitating the painting of a surface that lies adjacent to another surface that is not to be painted contemporaneously. The apparatus comprises a roller applicator, a shield, a paintbrush, a handle, and a platform. The shield can rotate between a paint loading position and a paint application position. The handle is connected to the platform by a universal joint which allows the handle to be disposed at any angle relative to the platform, which, in turn, allows the painting apparatus to be used in conjunction with an extension pole in edging a wall along a ceiling without requiring the use of a ladder.

9 Claims, 5 Drawing Sheets

PAINTING APPARATUS

CROSS REFERENCE TO RELATED APPLICATIONS

This application is a continuation-in-part that claims priority of U.S. patent application Ser. No. 10/419,623 filed on Apr. 23, 2003 (abandoned) entitled "Paint Roller Apparatus with Rigid Member and Brush."

BACKGROUND

1. Field of the Invention

The present invention relates generally to the field of painting and more particularly, it relates to a paint edger device having a paint roller, a paintbrush, and a shield mounted on a platform that is in turn connected to a handle by means of a universal joint, which allows a user to paint the edge where a wall meets a ceiling without requiring the use of a ladder.

2. Description of the Prior Art

A major problem that is encountered when painting the edges of a wall is the difficulty in painting the edge where a ceiling or crown molding meets the wall without a ladder. It is desirable to paint this edge by rolling a paint roller applicator substantially perpendicular thereto. However, due to the fixed perpendicular displacement of the handle relative to the roller applicator in a typical paint roller, a ladder is required to elevate a painter in order to keep the roller fully engaged with the wall. The requirement of a ladder is very time-consuming because the user must climb up and down the ladder and move it constantly due to the limited reach afforded thereby.

A number of prior devices have been developed in an effort to combine a roller applicator with a handle that swivels or rotates in two planes, but they do not allow a user to paint precisely up to the edge of a surface to be painted. Additionally, other prior devices have combined a roller applicator with a shield and paintbrush to paint precisely up to the edges of a wall, but a ladder is required to paint the edge of a wall adjacent a ceiling.

SUMMARY

A primary object and/or advantage of the present invention is to combine the precision of a paintbrush and the speed of a paint roller with a handle that has at least two degrees of freedom. This freedom of movement allows a user to take advantage of the efficiency of an extension pole to apply paint quickly and accurately up to the edge of a surface without any spillover of paint onto an adjacent surface.

A more specific object and/or advantage of the present invention is to provide a painting apparatus to paint the top edge of a wall adjacent to a ceiling or crown molding when using an extension pole, thus eliminating the need for a ladder.

It is another object and/or advantage of the present invention to make the handle lock onto the platform to facilitate the paint loading process.

Another object and/or advantage is to attain the present invention in a construction that is simple and economical to manufacture.

The present invention is an apparatus that is useful for painting along the edge of a surface to be painted that lies adjacent to another surface that is not to be painted contemporaneously without having to use a ladder to reach high edges. The invention resides in the unique configuration of a paint roller, a paintbrush, a shield, a rigid platform, and a handle having at least two degrees of freedom into a single paint application apparatus. The roller applicator is rotatably connected to the platform by means of an axle that is substantially parallel to and offset from one end of the platform. The platform is operably connected to the handle by a connection means allowing at least two degrees of freedom. This connection means allows the apparatus to be used with the handle disposed at any angle relative to the roller applicator instead of only orthogonally disposed thereto as in the prior art. This connection means further allows the painting apparatus to be mountable onto an extension pole in order to edge higher places on the wall such as the edge bordering the ceiling without requiring the use of a ladder. The platform further includes a rotatably attached shield with a paintbrush mounted on its inside face. In the paint application position, the shield is positioned substantially orthogonal to the longitudinal axis of the roller applicator.

Other objects and/or advantages of the present invention will become apparent from a reading of the Specification and claims.

DRAWING FIGURES

Figure 5:
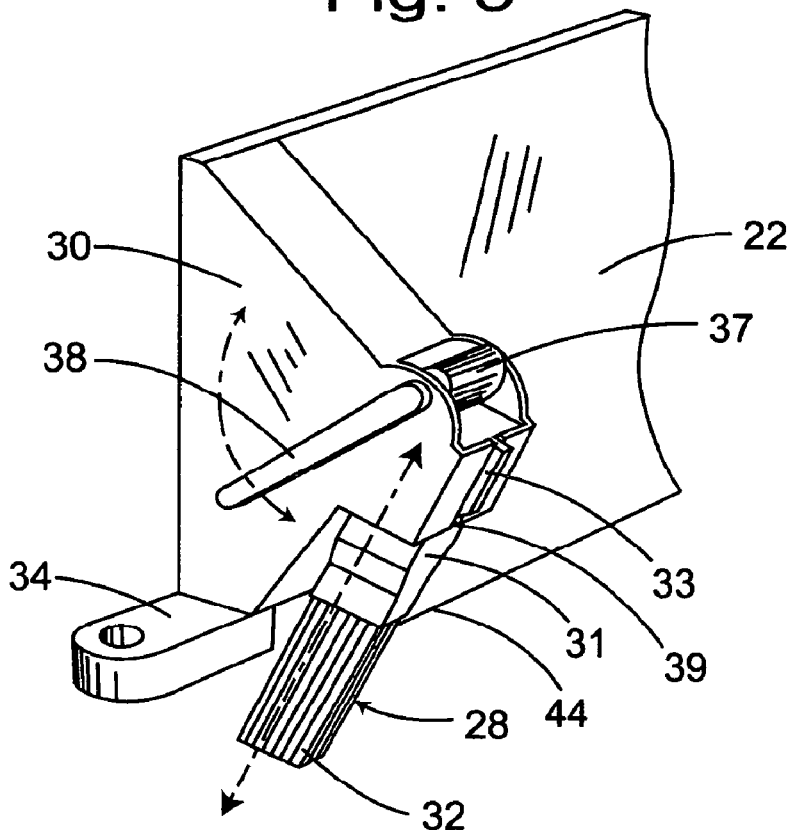

FIG. 5 presents a partial perspective view of the shield and paintbrush illustrating the paintbrush adjustment means comprising a cam and lever.

Figure 6:
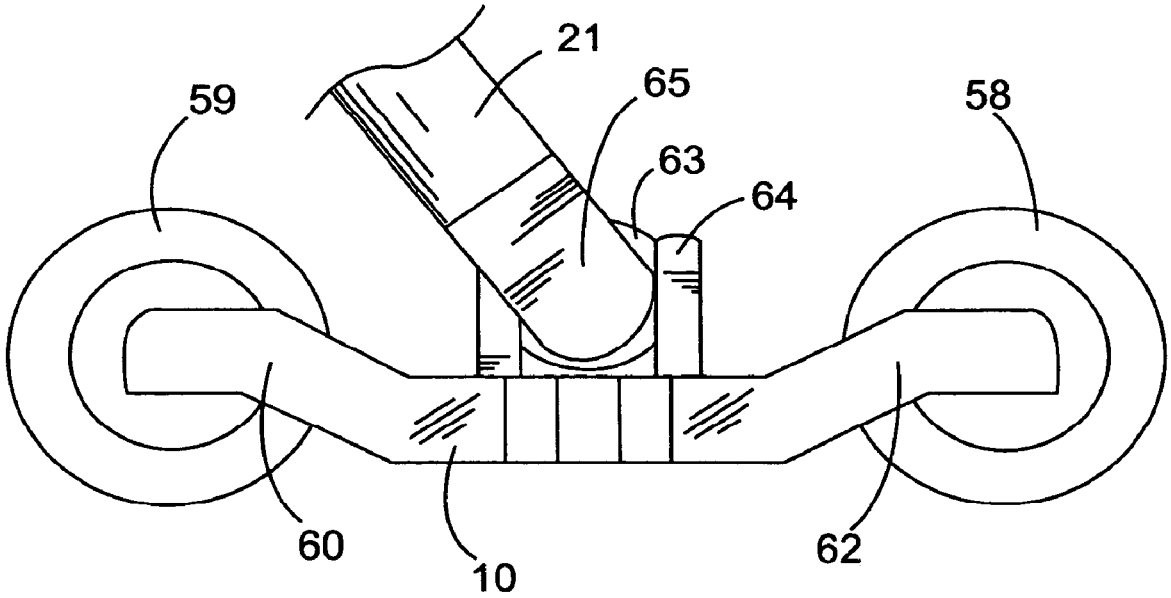

FIG. 6 presents a side view depicting an alternative embodiment of the invention with two roller applicators.

Figure 7:
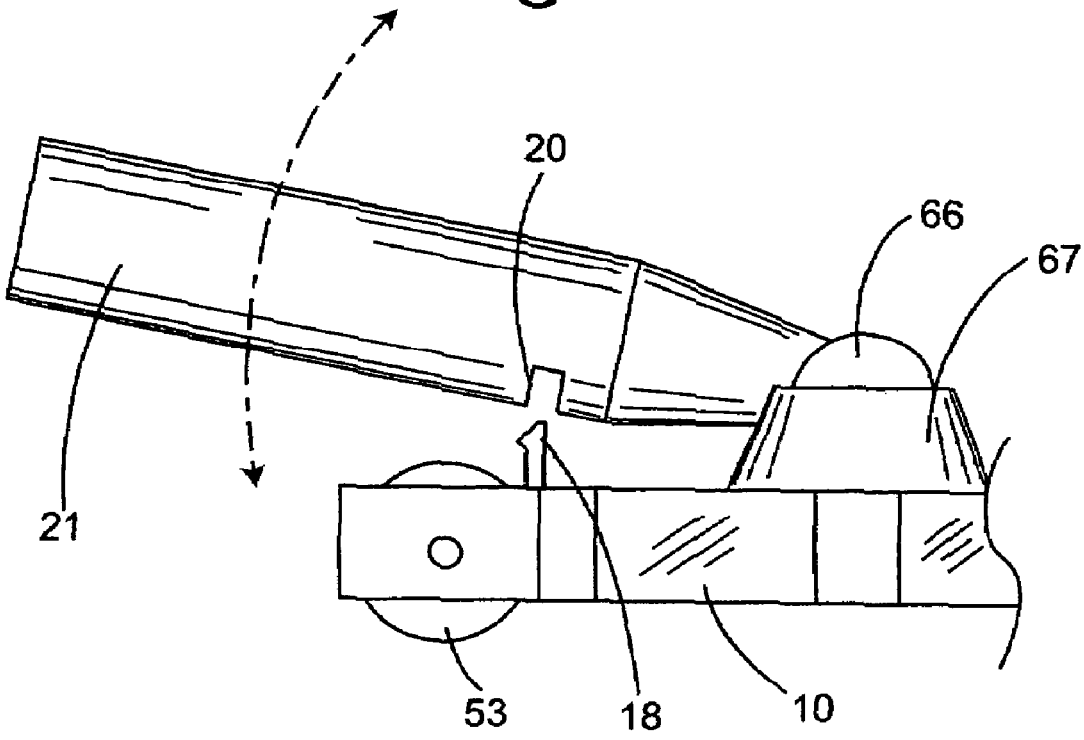

FIG. 7 is a partial side view depicting the invention with a ball and socket joint instead of the universal joint of the preferred embodiment.

Figure 8:
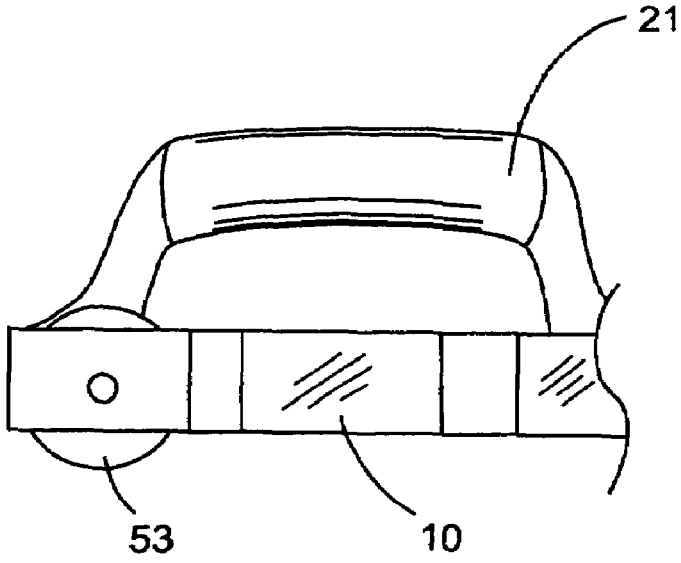

FIG. 8 is a partial side view showing an alternative handle that is fixedly attached to the platform instead of rotatably attached thereto as in the preferred embodiment.

Figure 1:
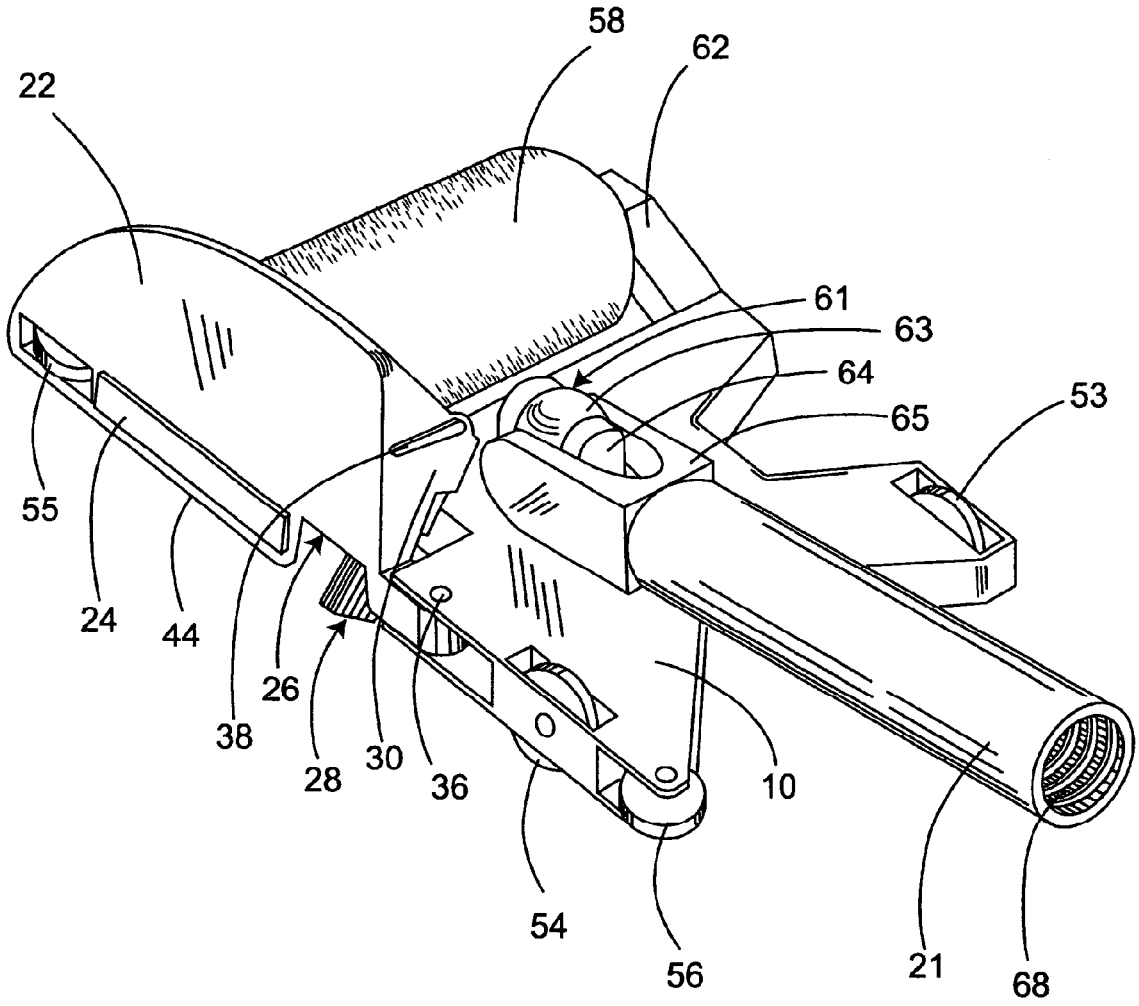
FIG. 1 is a perspective view of a first embodiment of the present invention in a paint application position illustrating its use in painting a wall surface adjacent a trim piece such as a doorframe, or window frame.
Figure 2:
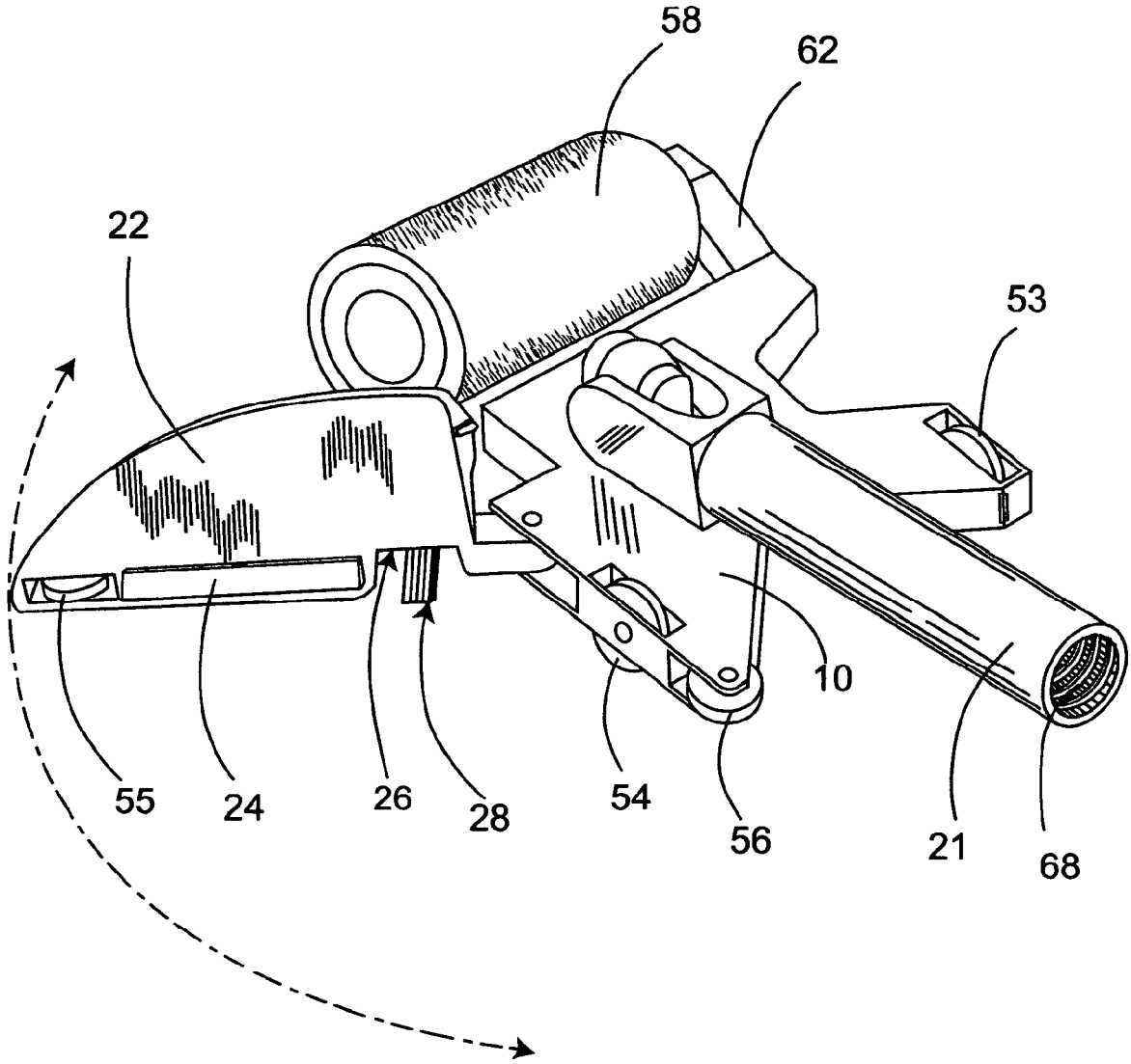
FIG. 2 is another perspective view depicting the invention with the shield rotated away from the roller applicator in a paint loading position.
Figure 3:
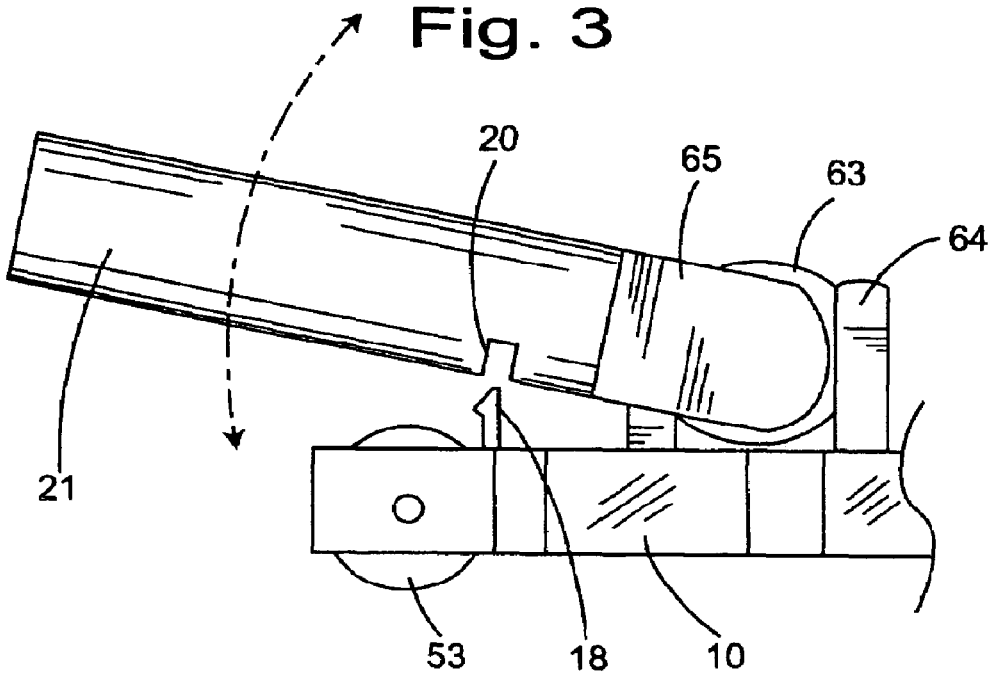
FIG. 3 is a partial side view of the invention showing a handle locking means.

DESCRIPTION—FIGS. 1 to 3—PREFERRED EMBODIMENT

FIG. 1 shows the preferred embodiment of a painting apparatus in a paint application position comprising a handle (21), a roller applicator (58), and a shield (22) with a paintbrush (28) all connected to a platform (10). Platform (10) is comprised of a substantially flat plate of predetermined shape. Roller applicator (58) is rotatably connected to a roller arm (62), which in turn is affixed to platform (10). Shield (22) is operably connected to platform (10) by a shield connector (36) and paintbrush (28) is connected to shield (22) by means of a paintbrush holder (30). Paintbrush (28) slides into paintbrush holder (30) and is frictionally held in place. In the preferred embodiment, handle (21) has a threaded opening (68) at its distal end to allow a user to attach an extension pole. In the paint application position, the plane of platform (10) is substantially parallel to the surface to be painted, and shield (22) is substantially orthogonal to roller applicator (58) and adjacent to distal end of roller applicator (58). FIGS. 1 and 2 further show that platform (10) supports trim wheels (55 and 56), and wall wheels (53 and 54).

FIG. 1 also shows that handle (21) is operably connected to platform (10) by a universal joint (61) which allows two degrees of freedom in the movement of handle (21) relative to said platform. Universal joint (61) is comprised of a yoke (65) on handle's (21) proximal end connected to a yoke (64) on platform (10) by means of a yoke connector (63). In the preferred embodiment, said universal joint exhibits a predetermined amount of friction between yokes (64 and 65) and yoke connector (63) such that handle (21) stays in a position unless a predetermined amount of force is exerted on said handle to cause displacement thereof. The point of connection of handle (21) to platform (10) is substantially medial to wall wheels (53, 54) and roller applicator (58).

FIG. 1 clearly shows that the painting apparatus has a paintbrush (28) control means comprising two trim wheels (55 and 56), two wall wheels (53 and 54), and shield (22) with a spacer tab (24). One trim wheel (55) is operably mounted on the shield (22) side of platform (10) and second trim wheel (56) is operably mounted on shield (22). In the paint application position, both trim wheels (55 and 56) rotate on axes that are substantially perpendicular to the plane of the surface to be painted such that said trim wheels roll on an adjacent surface. Said trim wheels and spacer tab (24) protrude a predetermined distance from the outside face of shield (22) and act as guides to prevent shield (22) from contacting said adjacent surface that is not to be painted and thus prevent smearing and marking thereof with paint and also act to position paintbrush (28) correctly in relation to the edge of the surface to be painted. FIGS. 1 and 2 also show that paintbrush (28) is positioned substantially between trim wheels (55 and 56) and between roller applicator (58) and wall wheel (54) and is free to extend past the plane of shield (22) through cutout (26). In the paint application position as seen in FIG. 1, the axis of rotation of wall wheels (53 and 54) are substantially parallel to the longitudinal axis of roller applicator (58). In combination, wall wheels (53 and 54), trim wheels (55 and 56), and shield (22) create a guide that precisely controls the distance between paintbrush (28) and adjacent surface, as well as controlling the amount of flex in paintbrush (28), thereby precisely controlling how close bristles (32) of said paintbrush reach to the edge of the surface to be painted.

In FIG. 2, the painting apparatus is shown in the paint loading position with shield (22) rotated away from roller applicator (58) to facilitate the loading of paint thereon without fouling shield (22) with paint. In the preferred embodiment, shield (22) rotates away from roller applicator (58) on a shield axis (36) substantially perpendicular to and offset from the longitudinal axis of roller applicator (58). Shield (22) is then frictionally held in the paint loading position until manually moved by the user. FIGS. 1 and 2 further show that shield (22) is comprised of a substantially flat disk of predetermined shape. In the preferred embodiment, shield (22) has at least one flat bottom edge (44), which contacts surface to be painted in the paint application position.

FIG. 3 shows a handle locking means. Said locking means includes a locking tab (18) proximal end of which is connected to platform (10) and distal end of which is free to bend when pressure is applied thereto. Locking tab (18) also exhibits memory such that locking tab (18) returns to its original position when said pressure is removed. Said locking means also includes a matching aperture (20) in handle (21). Said aperture is slightly offset from locking tab (18) such that when handle (21) is rotated down into contact with locking tab (18) said locking tab enters aperture (20) and is forced to bend and springs back to its predisposed position inside handle (21), thus preventing movement thereof. When handle (21) is pulled away from locking tab (18) with a predetermined amount of pressure, locking tab (18) bends and handle (21) is released and free to rotate up and away therefrom.

Figure 4:
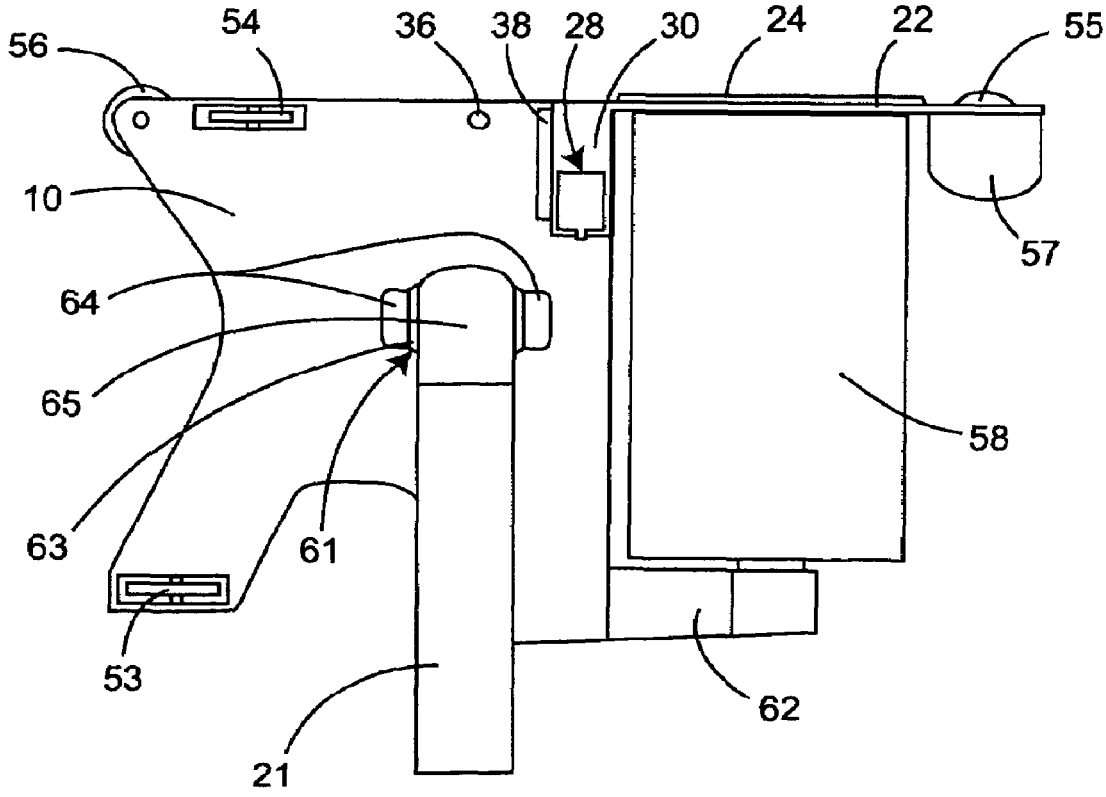
FIG. 4 is a top view showing the handle oriented substantially orthogonal to the shield, illustrating the handle's position when edging along the top of a wall.

FIG. 4 shows the invention with handle (21) disposed substantially orthogonal to shield (22). Universal joint (61) enables handle (21) to rotate in a plane that is substantially parallel to the longitudinal axis of roller applicator (58) instead of restricting said handle to rotating in a plane that is fixedly perpendicular thereto as in the prior art. FIG. 4 also shows that trim wheel (55) is protected by a wheel cover (57) to protect against paint spray from the roller applicator (58)

Referring now to FIG. 5 there is shown more detail about paintbrush (28) and shield (22). Said paintbrush is comprised of bristles (32) and a ferrule (31). Paintbrush (28) is mounted onto shield (22) at a predetermined angle such that bristles (32) are angled into the edge of the surface to be painted. Furthermore, paintbrush's (28) paint application area partially overlaps the paint application area of roller applicator (58), thereby allowing paintbrush (28) to partially redistribute the paint previously applied by roller applicator (58) closer to the edge of the surface to be painted. Shield (22) is connected to platform (10) via shield arm (34). Said shield rotates on an axis that is substantially orthogonal to the plane of platform (10).

FIG. 5 also shows that ferrule (31) has a projection (33) on one side, which matches a slot (39) on paintbrush holder (30) such that paintbrush (28) fits into paintbrush holder (30) in only one orientation. Ferrule (31) is frictionally held in paintbrush holder (30). Said paintbrush can then be easily adjusted to compensate for wear of the bristles, or be removed completely for cleaning and replacement. Bristles (32) extends past bottom edge (44) of shield (22) a predetermined distance in order to urge a proper degree of bending in bristles (32) when wall wheels (53 and 54) and shield (22) are in contact with the surface to be painted in the paint application position, thus allowing paintbrush (28) to effectively apply paint to the edge of the surface to be painted. FIG. 5 shows that the distance that paintbrush (28) extends past bottom edge (44) of shield (22) is adjustable with a cam device comprised of a lever (38) and a cam (37). Rotation of lever (38) rotates cam (37), which in turn controls how deeply paintbrush (28) is seated in paintbrush holder (30). This feature allows a user to adjust for wear on paintbrush (28) as well as adjust for different surfaces to be painted. FIG. 5 also shows that in the preferred embodiment, paintbrush (28) is a flat paintbrush, but clearly other paintbrush shapes are possible and are within the scope of this invention.

In a preferred embodiment of paintbrush (28), the width of said paintbrush is approximately 15 millimeters in order to move enough paint to the edge of the surface to be painted, but any size paintbrush (28) can be used as long as the required results are obtained. The preferred material for bristles (32) of said paintbrush is nylon or polyester, or some combination of the two. However, other materials may be used such as natural hairs, or even foam depending on the type of paint to be applied.

FIGS. 6 TO 8—ALTERNATIVE EMBODIMENTS

An alternative to the preferred embodiment is depicted in FIG. 6. A second roller applicator (59) is connected to platform (10) via a second roller arm (60). Roller applicator (59) replaces wall wheels (53 and 54). While being more costly to manufacture, second roller applicator (59) provides the added advantages of quieter operation and the ability of roller applicators (59 and 58) to cover the paintbrush (28) marks on both the up and down strokes (or back and forth strokes).

FIG. 7 shows in a partial side view that an alternative to the pivoting handle connection means (61) comprising yokes (64 and 65) and connector (63) of the preferred embodiment is a handle connection means comprising a ball (66) and a socket (67). There are several other equivalent means for pivotally connecting handle (21) to platform (10) and all of said equivalent means are within the scope of this invention.

FIG. 8 presents a partial side view showing that handle (21) can be non-operably affixed to platform (10). This embodiment would not allow a user to attach an extension pole to reach high corners, but would be very economical to manufacture and could be used as a mini paint edger to operate in smaller spaces. Handle (21) in this embodiment can obviously be of any shape and are within the scope of this invention.

ADVANTAGES

From the description above, a number of advantages of my apparatus become evident:

(a) the apparatus reduces the amount of time required to paint surface edges;

(b) the apparatus simplifies the painting process for all painters;

(c) the addition of a universal joint type connection between the handle and platform allows users to paint a wall up to a ceiling without having to climb up on a ladder;

(d) the addition of a platform eliminates the need for a pivoting shield and allows the shield to be pressed closer to the roller applicator, thus enabling the roller applicator to apply paint closer to the surface edges and reducing the amount of paint the paintbrush has to apply; and (d) the apparatus is more stable than prior art when used with an extension pole.

OPERATION—FIGS. 1 TO 4

The manner of using this painting apparatus is similar to that for paint rollers in present use. The only difference is that the user of this apparatus first has to position correctly shield (22) in one of two positions: the paint application position, or the paint loading position. In the paint application position (FIG. 1), shield (22) is substantially perpendicularly adjacent to roller applicator (58). In the paint loading position (FIG. 2), shield (22) is rotated away from roller applicator (58). Shield (22) is manually rotatable from one position to the other. Shield (22) will stay in place due to friction caused by shield connector (36).

To load roller applicator (58) with paint, the user first has to make sure shield (22) is in the paint loading position (FIG. 2). Also, before loading roller applicator (58) with paint, handle (21) is rotated down into contact with locking tab (18) such that aperture (20) communicates with locking tab (18) and handle (21) is locked into a position substantially parallel to the plane of platform (10) (FIG. 3). This position will prevent paint from fouling platform (10) when loading the roller applicator with paint. The user can then dip roller applicator (58) into paint that is in a paint tray or a paint bucket in the traditional method. Once roller applicator (58) is sufficiently loaded with paint, shield (22) is rotated into the paint application position (FIG. 1) and handle (21) is manually pulled away from locking tab (18). Once shield (22) is in the paint application position, the painting operation can commence. To start painting, trim wheels (55 and 56) are placed in contact with the adjacent surface such that the longitudinal axis of roller applicator (58) is substantially perpendicular to said adjacent surface and such that wall wheels (53 and 54) and roller applicator (58) contact said surface to be painted. The apparatus is then rolled up and down the surface to be painted keeping trim wheels (55 and 56) flush with said adjacent surface. This action is continued until roller applicator (58) expends the paint and needs to be reloaded with paint. At which time, the paint loading operation is repeated.

To paint higher edges that would normally require the use of a ladder, an extension pole is screwed into the distal end (68) of handle (21). FIG. 4 shows the invention in position to edge the top of a wall where it meets a ceiling. Specifically, handle (21) is positioned substantially orthogonal to shield (22) and is lifted via said extension pole to the top of the wall and positioned such that trim wheels (55 and 56) contact the ceiling, or molding; and roller applicator (58), and wall wheels (53 and 54) contact the wall. The user then rolls the apparatus back and forth along the top of the wall while standing on the floor.

CONCLUSION, RAMIFICATIONS AND SCOPE

The painting apparatus of this invention can be used to significantly reduce the amount of time needed to paint the walls of a room. In addition, this apparatus greatly simplifies the process of edging such that even a novice painter can paint quickly and accurately around surfaces that are not to be painted such as doorframes and window frames. Furthermore, the roller paintbrush apparatus has additional advantages in that:

it permits the user to paint quickly and precisely up to an edge that is vertical, horizontal, or any angle therebetween;

it reduces the amount of time needed to trim a room by eliminating the need for a ladder in edging the tops of walls;

it eliminates the problem of paint seeping under a shield and smearing on an adjacent surface by providing a paintbrush which allows the shield to be held away from the adjacent surface;

it reduces the amount of time needed to trim a room by eliminating the need to tape around objects not to be painted, or trim around them with a paintbrush; and it permits easier rotation of the roller applicator along the surface to be painted by eliminating the need for the roller applicator to be pressed tightly against a shield, thus reducing rotating friction.

Although the description above contains many specificities, these should not be construed as limiting the scope of the invention, but as merely providing illustrations of some of the presently preferred embodiments of this invention. It is specifically stated that the present invention is not limited to any overall dimensions. For example, said roller applicator can be less than four inches long to the more conventional nine-inch length; and the diameter of the roller applicator can be of any functional size. Furthermore, the shape of the shield can be trapezoidal, triangular, semi-circular, or completely curvilinear; the shield can comprise one or more trim wheels; the trim wheels of the invention can also be replaced with non-rotating tabs; the paintbrush can be mounted on the platform instead of the shield; and the means of raising or lowering the paintbrush can be a thumbscrew means or other adjustment means. Furthermore, it is stated that the present invention is not limited to any material, so long as the material accomplishes the required task.

Thus the scope of the invention should be determined by the appended claims and their legal equivalents, rather than by the examples given.

What is claimed is:

1. A paint application apparatus for applying paint on a surface and up to an edge of the surface without applying paint on an adjacent surface extending from the edge, comprising:

a handle having a longitudinal axis;

at least one roller applicator for rolling on and applying paint to the surface;

a substantially rigid platform rotatably attached to said handle by means of a joint which pivotally secures said handle to said platform allowing at least two degrees of freedom and said platform also including a roller arm that is operably attached to said roller applicator such that said roller applicator is at an angle substantially orthogonal to said roller arm and substantially coplanar with said platform;

a shield operably attached to said platform and positioned for moving along the adjacent surface to position said roller applicator on the surface a predetermined distance from the adjacent surface;

and a paintbrush attached to said paint application apparatus for applying paint on the surface up to the edge without applying paint to the adjacent surface, wherein said paintbrush is positioned to partially redistribute the paint previously applied by said roller applicator closer to the surface edge.

2. The paint application apparatus of claim 1, wherein said paintbrush is removably attached to said paint application apparatus.

3. The paint application apparatus of claim 2, wherein said paintbrush is attached to said paint application apparatus to engage with the surface at a non-orthogonal angle.

4. The paint application apparatus of claim 3, wherein said paintbrush comprises a cam adjustment means.

5. The paint application apparatus of claim 1, further comprising a locking tab for releasably locking said handle to said platform and selectively preventing rotation therebetween.

6. The paint application apparatus of claim 1, wherein said shield includes one or more projections for sliding along the adjacent surface.

7. The paint application apparatus of claim 1, wherein said shield includes one or more wheels for rolling along the adjacent surface.

8. The paint application apparatus of claim 1, wherein said platform includes one or more wheels for rolling along the surface to be painted.

9. A paint application apparatus for applying paint on a surface and up to an edge of the surface without applying paint on an adjacent surface extending from the edge, comprising:

a handle;

at least one roller applicator for rolling on and applying paint to the surface;

a substantially rigid and planar platform, said platform having an upper surface and first and second opposite sides, said handle being fixedly attached to the upper surface of the platform between the first and second sides thereof such that said platform and said handle are held in fixed position relative to the surface during a paint application operation and said platform also including a roller arm adjacent one of the sides of the platform that is operably attached to said roller applicator such that said roller applicator is at an angle substantially orthogonal to said roller arm and substantially coplanar with said platform, said platform further extending along substantially the entire length of the roller applicator between the opposite sides thereof;

a shield operably attached to the other side of said platform and positioned for moving along the adjacent surface to position said roller applicator on the surface a predetermined distance from the adjacent surface;

and a paintbrush attached to said paint application apparatus for applying paint on the surface up to the edge without applying paint to the adjacent surface, wherein said paintbrush is positioned to partially redistribute the paint previously applied by said roller applicator closer to the surface edge.

* * * * *